United States Patent [19]

Cantrell, Jr. et al.

[11] 4,023,508

[45] May 17, 1977

[54] APPARATUS TO BURN WASTE COMBUSTIBLE POLYMERS

[75] Inventors: Clifford J. Cantrell, Jr.; Gary D. Hanlon, both of Tulsa, Okla.

[73] Assignee: John Zink Company, Tulsa, Okla.

[22] Filed: Apr. 22, 1976

[21] Appl. No.: 679,397

[52] U.S. Cl. ..... 110/8 A; 110/8 C; 110/10

[51] Int. Cl.[2] ..... F23G 5/12

[58] Field of Search ..... 110/8 R, 8 A, 8 C, 10, 110/14, 18 R, 18 C

[56] References Cited

UNITED STATES PATENTS

| | | | |
|---|---|---|---|
| 3,041,986 | 7/1962 | Reilly | 110/10 |
| 3,417,717 | 12/1968 | Jacoborici | 110/18 |
| 3,490,395 | 1/1970 | Boyd et al. | 110/18 |
| 3,651,771 | 3/1972 | Eberle | 110/8 |
| 3,716,339 | 2/1973 | Shigaki et al. | 110/14 |
| 3,841,239 | 10/1974 | Nakamura et al. | 110/8 |

*Primary Examiner*—Kenneth W. Sprague

*Attorney, Agent, or Firm*—Head, Johnson & Chafin

[57] ABSTRACT

Apparatus for burning waste polymers of selected combustion characteristics. A vertical or horizontal combustion assembly includes a base cylindrical portion having water-cooled walls to maintain a selected temperature by removal of the heat of combustion, a plurality of pipes for injecting combustion air tangentially into the interior space, a loading port in the wall of the base section and a burner for igniting the waste matter injected through the loading port. Downstream of the base section is a ceramic choke which has an axial opening therethrough of lesser diameter than an internal diameter of the base section followed by an afterburning chamber, which like the base section, has a plurality of air inlet pipes tangential to the chamber and a burner port for igniting vapors in the upper chamber. Combustion air is controlled so that less than stoichiometric air is injected into the lower chamber to provide a reducing atmosphere, with excess combustion air in the afterburning section. The outlet of the afterburning chamber goes to the stack.

8 Claims, 5 Drawing Figures

APPARATUS TO BURN WASTE COMBUSTIBLE POLYMERS

BACKGROUND OF THE INVENTION

This invention lies in the field of the combustion of waste solid and semi-solid materials.

More particularly, this invention lies in the field of combustion of waste polymer material such as polyethylene, plastics, rubber compounds, semi-solid sludges and other combustible solids.

In the prior art, there have been large quantities of waste plastic materials that must be disposed of, and these have been burned in conventional incinerators, with considerable difficulty. Many problems arise because of incomplete combustion, and resulting pollution of the atmosphere with smoke and toxic chemicals. Other problems arise out of excessive temperatures in the combustion apparatus, etc.

It is, therefore, a primary object of this invention to provide a combustion system whereby selected solid materials, such as polymers, that will melt at a selected temperature, can be burned under conditions of controlled temperature and complete combustion, with utilization of the heat of combustion.

It is a further object of this invention to provide a system in which the solid material is melted and vaporized in a first section, under reducing conditions, to provide products of combustion which flow into an afterburner section, where the gases are completely burned with excess air, under controlled temperature conditions, so as to inhibit the production of nitrogen oxides.

It is a further object of this invention to provide a combustion system for polymer waste material, in which the solid material is melted, forming a liquid pool, which burns at the surface under reducing conditions, to provide products of combustion which rise to an afterburner chamber, where the gases are completely burned in the presence of excess air.

SUMMARY OF THE INVENTION

These and other objects are realized and the limitations of the prior art are overcome in this invention by providing a cylindrical aparatus (horizontal or vertically oriented) having three tandem sections, a base section with water-cooled walls, which, while maintaining a selected temperature in the combustion zone, provide means for removing the heat of combustion for use elsewhere if desired. Port means are provided for loading the waste matter into the lower chamber. A burner or other means is provided for ignitng the solid material. The partial burning of the solid material provides an operating temperature such that the material melts and forms a liquid pool on the base of the chamber. Combustion air is injected into the chamber through a plurality of pipes, under pressure, for the partial combustion of the material under reducing conditions.

The gaseous products of combustion pass through a ceramic choke at the top of the lower chamber into an afterburner section mounted on top of the choke. Here a burner provides means for ignition of the combustible vapors rising through the choke, and excess combustion air is provided, under pressure, through a plurality of pipes, tangential to the afterburner chamber, providing a means for longer residence time and turbulent mixing, so as to completely burn all of the combustible components of the waste material.

As a further means for maintaining a limiting temperature in the afterburner chamber, steam, water particles, water vapor, air or inert gases may be injected under control, so as to dilute and cool the products of combustion before they enter the stack.

BRIEF DESCRIPTION OF THE DRAWINGS

These and other objects and advantages of the invention and a better understanding of the principles and details of the invention will be evident from the following description taken in conjunction with the appended drawings in which.

DESCRIPTION OF THE PREFERRED EMBODIMENT

Before explainig the present invention in detail, it is to be understood that the invention is not limited in its application to the details of construction and arrangement of parts illustrated in the accompanying drawings, since the invention is capable of other embodiments and of being practiced or carried out in the various ways. Also, it is to be understood that the phraseology or terminology employed herein is for the purpose of description and not of limitation.

Figure 1:
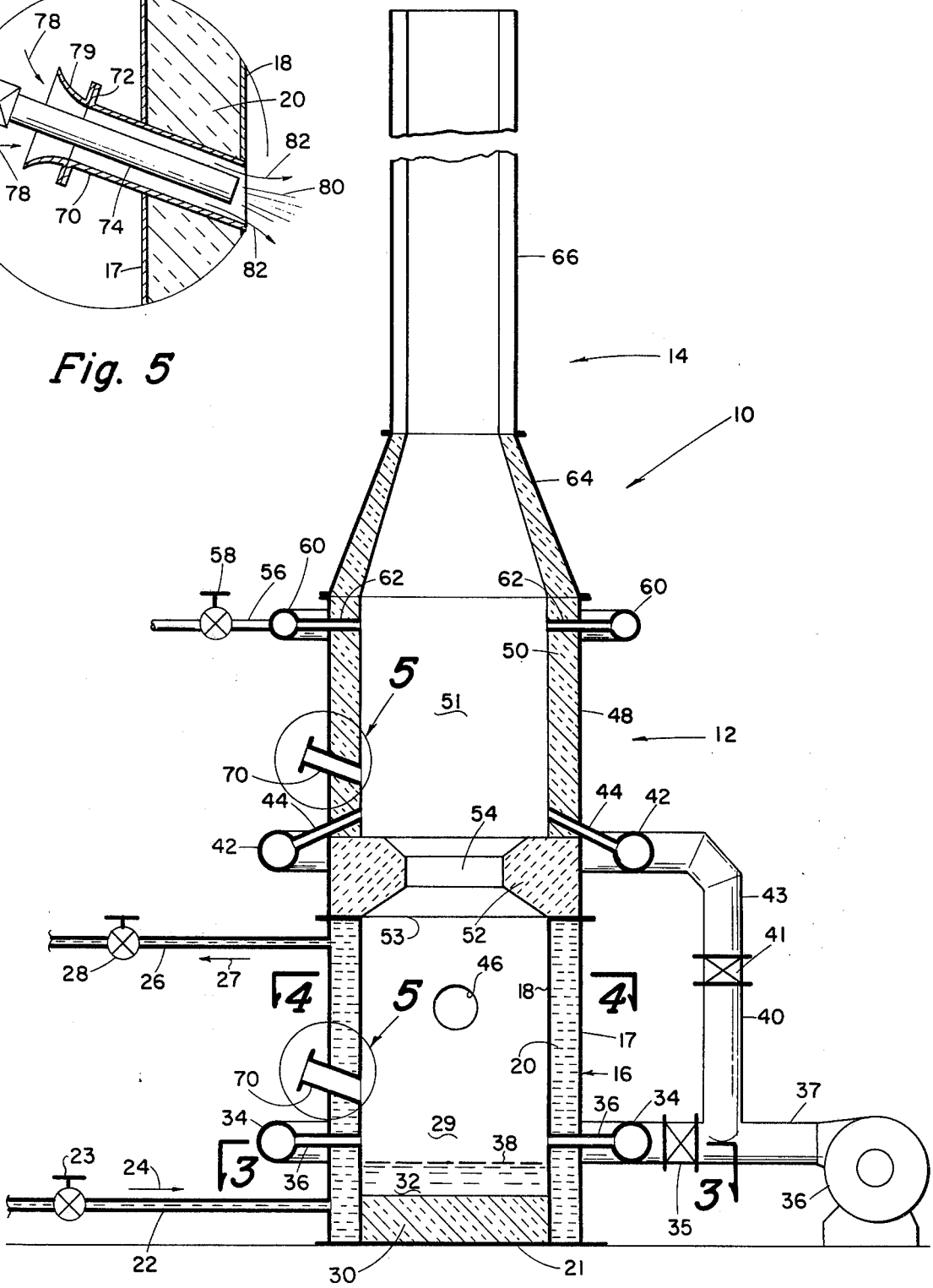
FIG. 1 is a vertical cross-section of the apparatus of this invention.

Referring now to the drawings and in particular to FIG. 1, there is shown in vertical cross-section a view of the complete assembly 10 of this invention. The invention includes three basic parts (plus a stack as needed), a lower combustion chamber 16 which as a reducing atmoshere, into which the solid material is injected with combustion air of less than stoichiometric quantity, an intermedite section 52 which is a ceramic choke having a reduced central opening for passage of products of combustion from the lower chamber, and on top of the choke a third section 12 where gases produced in the reducing atmosphere of the lower chamber are completely burned with excess air.

Numeral 16 illustrates generally the lower or reducing chamber. Numeral 12 indicates generally the upper or afterburning chamber. Numeral 14 indicates the stack where the products of combustion are ejected into the atmosphere. The lower chamber 16 comprises a double-walled, vertical cylindrical chamber, having a base 21, outer wall 17, inner walls 18, and a top flange 53 for attachment to the choke portion.

Water is supplied to the annular space 20 between the outer and inner walls, 17 and 18, by means of an inlet water pipe 22 in which the water flows in accordance with arrow 24 controlled by a valve 23. The inlet water comes in at the base of the lower chamber and leaves as hot water or steam, as the case may be, in accordance with arrow 27 through an outlet pipe 26, at the top of the chamber. The back pressure is controlled by means of an outlet valve 28.

The purpose of the water jacket is two-fold, to control the temperature in the lower reducing chamber of the waste material burned in the chamber. There is a ceramic base 30 in the chamber so that the solid material which can be injected into the internal space 29 through a port 46 which will be described further in connection with FIG. 4.

This system is adapted for the combustion of waste materials which melt at a selected temperature, such as polymer materials, such as polyethylene, polypropylene and thermoplastic materials in general. The temperature that is maintained in the lower chamber is such as to melt these materials, which form a liquid pool 30 having a surface 38. A port 70 is provided in the wall of the lower chamber into which a burner is inserted, so as to provide a means for ignitig the solid materials, and providing burning at the surface 38 of the liquid pool 32. Details of the burner will be described in relation to FIG. 5.

Figure 3:
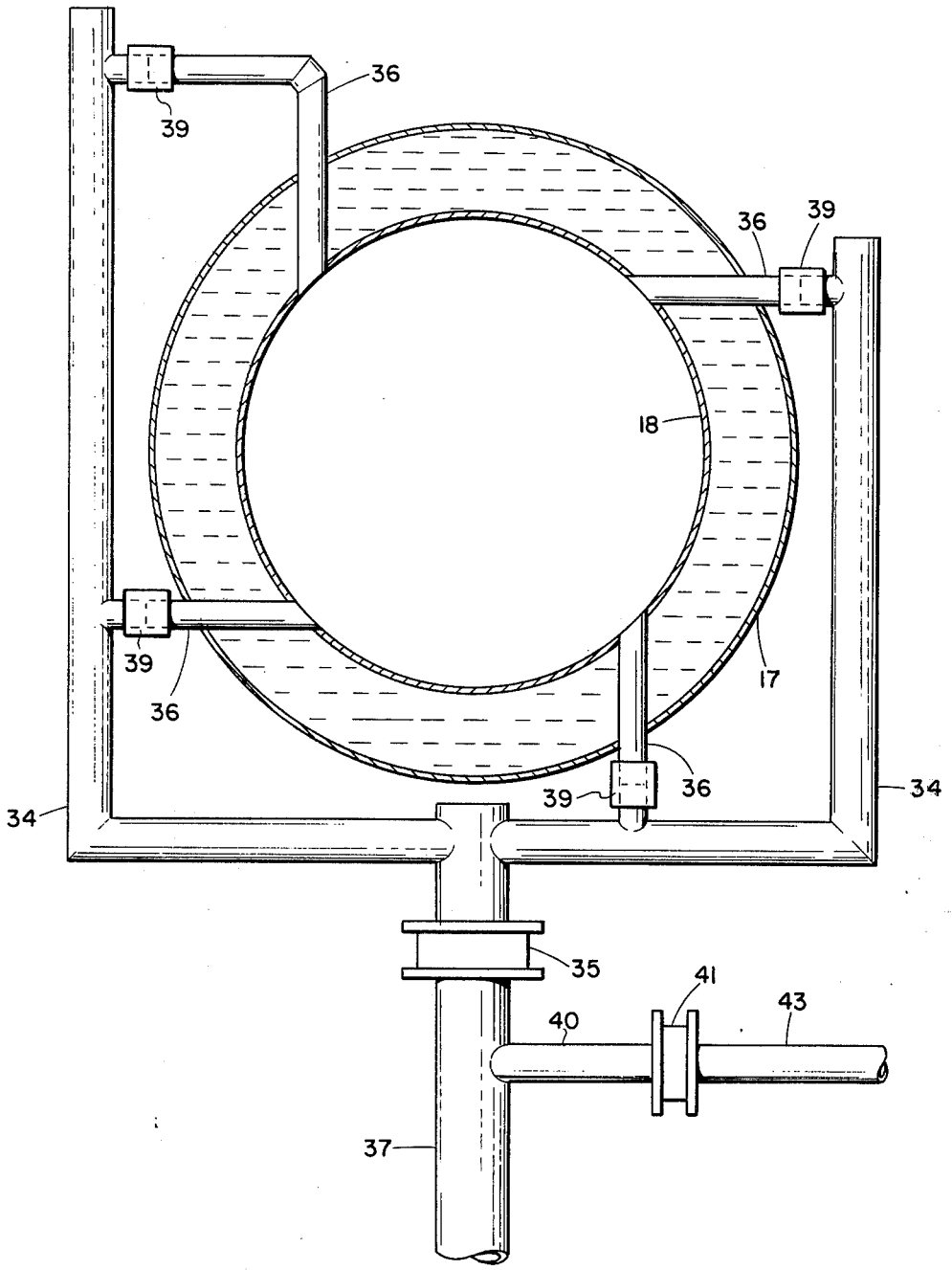
FIG. 3 is a detail of the lower chamber showing the system for introducing combustion air.

A plurality of tangential pipes 36, as will be described in connection with FIGS. 3, are inserted through the wall of the lower chamber at a point above the surface 38 of the molten material. There is a manifold 34 surrounding the lower chamber 16 connecting these pipes 36 through a damper 35, and pipe 37 to a compressor, blower or other source 36 of air under pressure. By means of the damper 35, the rate of flow of combustion air into the space 29 is controlled so as to maintain a reducing atmosphere. That is, the amount of air is less than that required for complete combustion of the elements in the material being burned. By use of a reduced volume of combustion air, the products of combustion generated in the lower chamber are still combustible, and will move upwardly into the afterburning or upper chamber 12.

The purpose of the choke 52, which because of the high temperature is made of ceramic material, is to provide an opening 54 of reduced cross-section, so that the gases in the space 29 will be restrained from passing upwardly through the opening 54.

The upper chamber 12 extends up from the choke, and can be a part of, or a separate attachment to the choke 52. The upper chamber 12 comprises an outer wall 48 with thermal insulation 50 over the inner surface.

Near the bottom of the upper, or afterburnig chamber, are a plurality of air inlet pipes 44 similar to those 36 in the lower chamber, but which are tilted upwardly and tangentially, to cause a swirling helical motion of the gases in the upper section to provide intimate mixing and longer residence time, and therefore more complete combustion. A manifold 42 is provided to carry the air to the pipes 44.

As shown in FIG. 1, the manifold 42 is connectedby pipe 43 and a secondary air damper 41, and pipe 40, to the air supply 36. The damper 41 is used to provide excess air for combustion inside the afterburning chamber 51, so that all products of combustion are completely burned before they pass upward through section 64 to the stack 66.

In order to maintain a selected maximum temperature in the upper chamber, a plurality of pipes 62 are provided through the wall of the upper chamber near its top. These are connected to a steam manifold 60 which is provided with steam through valve 58 and pipe 56, in a conventional manner. Instead of steam water particles or vapor air or inert gases may be used.

Figure 5:
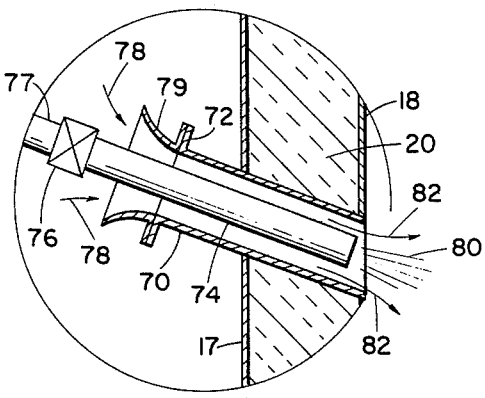
FIG. 5 illustrates the construction of the burner as applied to the lower reduction chamber and to the afterburning chamber.

As in the case of the lower chamber 16, a burner port 70 is provided, indicated generally by the numeral 5 and detailed in FIG. 5.

Figure 2:
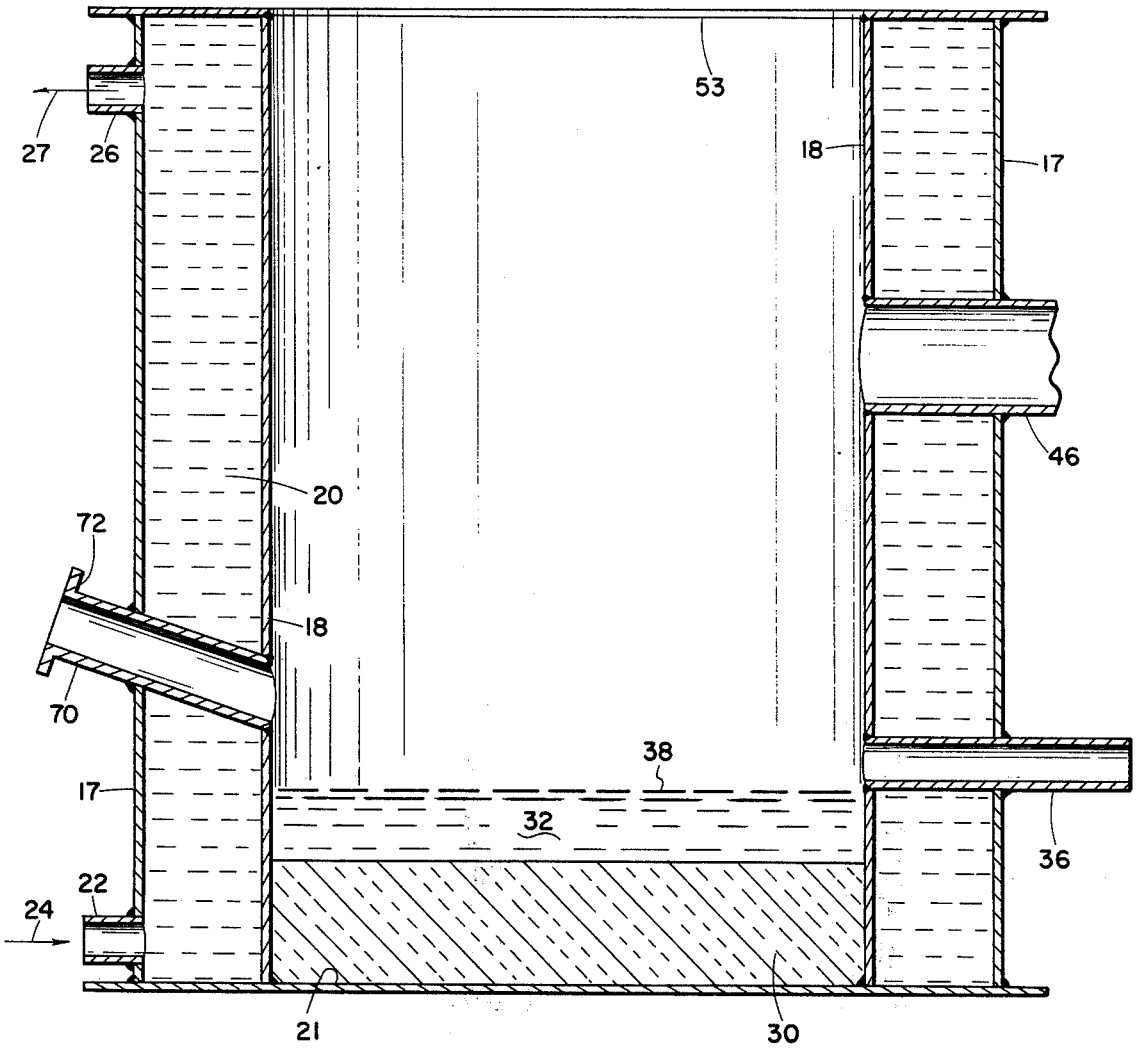
FIG. 2 is an enlarged detail view of the lower, or reducing chamber.

Reference is now made to FIG. 2 which shows in greater detail the construction of the lower reducing chamber, of the apparatus of this invention. It comprises a base plate 21 carrying a cylindrical outer wall 17 and a cylindrical inner wall 18, both of which are welded to the base and to a top flange 53. Inlet pipe 22 is provided at the bottom to carry water as indicated by the arrow 24 into the space 20 between the two walls, and to flow out through an upper pipe 26 in accordance with arrow 27. Numeral 36 indicates one of the plurality of air pipes which are postioned above the top of the ceramic material 30, which covers the base of the lower chamber. The tangential position of the air pipe will be discussed in connection with FIG. 3.

A burner port 70 with connection flange 72 is provided so that a burner flame can be directed inwardly, downwardly, to the surface 38 of liquid material 32, which will be formed on top of the base ceramic 30.

referring to FIG. 3, there is a manifold 34 which surrounds the base section outside of the outer wall 17. There are a plurality of pipes 36 which can be in any desired number but which, for convenience, are shown as 4, which are supplied with air under pressure from the manifold 34.

Indicated by numeral 39 is a flexible coupling, such as a rubber hose, which may be used between the pipes 36 leads from the manifold 34. As mentioned previously, and shown in FIG. 1 there is a damper 35 for control of the flow rate of air to the lower chamber from pipe 37 from the air compressor or blower 36 of FIG. 1.

There is a vertical pipe 40 (shown horizontal for convenience) which goes to a second damper 41 and pipe 43 to the plurality of air pipes 44 passing through the wall of the upper chamber shown in FIG. 1. The manifold and pipes will be similar to that shown in FIG. 3, except that the pipes 44 are tilted upwardly.

Figure 4:
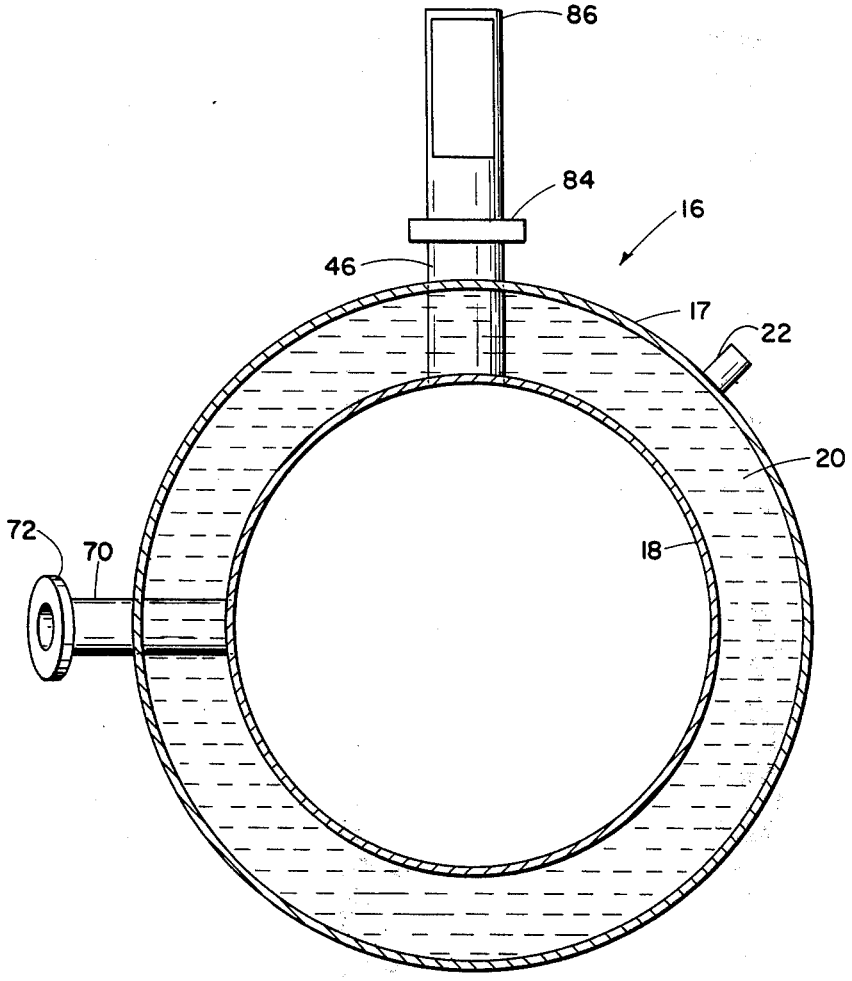
FIG. 4 is a detail of the lower chamber illustrating the port for entry of solid material, and the burner.

Referring now to FIG. 4, there is shown a cross-section of the lower chamber taken at the plane 4—4 of FIG. 1. This shows the inner and outer wall 17 and 18, and the burner port 70 with flange 72. It shows also one of the couplings 22 for the lower pipe for the introduction of water into the annular space 20 between the walls 17 and 18.

The port 46 as shown, has an opening through the wall, and has an air seal 84, and a loading means such as a fluid eductor, plunger ram, or loading feed screw, allows waste polymer material to be injected into the chamber. The loading apparatus 84 and 86 is conventional in every respect. No further detail is required, other than to point out that there is excess pressure above atmospheric, in the lower chamber, so that means must be provided for preventing the escape of hot products of combustion out through the port 46. This is part of the conventional design, indicated generally by the numeral 86.

Ports 70 have been shown in both the lower chamber 16 and the upper chamber 12 for the ignition of the solid and liquid material in the lower chamber, and ignition of the gaseous material in the upper chamber, which passes up through the choke opening 54. One embodiment of the burner is shown in FIG. 5. This comprises a burner tube 74 which is supported axially inside of the port 70 by means not illustrated, but well known in the art. Gas is supplied to the burner through a valve 76 and pipe 78. There is a conventional orifice in the end of the burner tube 74, which provides a long jet 80 of gas issuing at high velocity from the end of the burner tube 74. The high velocity of the gas jet 80 causes the induction of combustion air through the annulus between the burner tube 74 and the port wall 70 in the form of air flow indicted by arrows 78, through a flared portion 79 of the port, through the annular space, and into the interior 29 of chamber 16 in accordance with arrows 82, so that the jet of gas is mixed with the air 82 and burned. The flame that ignites the gas 80 is provided by conventional means and need not be further described.

What has been described is a three-part structure for the loading of solid particulate matter, ground into chunks or sizes suitable for burning through a loading port, into a lower combustion chamber where it is ignited by a burner. A selected combustion temperature is maintained in the lower combustion chamber, sufficient to melt the loaded material to form a liquid pool at the bottom of the chamber, so that the material will burn at its surface 38. The combustion of the liquid 32 is facilitated by air which is introduced under pressure through a plurality of tangential pipes 36 to provide turbulence and mixing of the gases rising from the surface 38. Less that stoichiometric air is provided, so that there will be a reducing atmosphere in the space 29, and combustible gaseous products will pass up through a choke 52 into the afterburning chamber 12. Here a burner is provided to ignite the gases, and a plurality of tangential air pipes 44 are provided. Means are provided to control the air flow so as to provide a less than stoichiometric quanitity in the lower chamber, and an excess of air in the upper chamber, so as to completely burn all of the combustible material. The tangential flow of air into both chambers serves to facilitate the mixing and combustion of the gases. In addition, steam flow is provided into the upper chamber, as necessary, to maintain a limited maximum temperature.

What is claimed:

1. Apparatus for burning waste particulate matter, comprising:

a. a cylindrical base portion, including;

1. double cylindrical walls and means to circulate water in at a bottom inlet and utilize steam at an upper outlet, and means to control the rate of water inflow, whereby a selected temperature can be maintained in said base portion;
2. means to inject solid particulate material of selected thermal and combustion characteristics at a port near the top of said base portion;
3. thermal insulating means over the base of said base portion adapted to support said particulate material;
4. burner means in said base section to ignite said particulate matter;
5. means to inject air under pressure, at a controlled rate for combustion of said particulate matter under reducing conditions, with less than stoichiometric air;

b. an intermediate choke portion, mounted on top of said portion, said choke of refractory material, having a central opening of smaller diameter than the diameter of said base portion;

c. an afterburner chamber on top of said choke portion; all three portions suitably fastened and sealed together and including;

1. said afterburner chamber lined with refractory;
2. means to inject excess combustion air under pressure, to completely burn the gases formed in the partial combustion in said base portion; and d. stack means to conduct to the atmosphere the products of combustion in said afterburner chamber.

2. The apparatus as in claim 1 including burner means in said afterburner chamber to ignite said gases formed in said base portion.

3. The apparatus as in claim 1 including means to controllably inject steam into said afterburner chamber to control the temperature therein.

4. The apparatus as in claim 1 in which said means to inject air under pressure comprises a plurality of pipes through the wall of said base portion directed tangential to the interior volume of said base portion.

5. The apparatus as in claim 1 in which said means to inject air under pressure comprises a plurality of pipes through the wall of said afterburner chamber near the base thereof.

6. The apparatus as in claim 1 in which said particulate matter includes materials which melt at a temperature below burning temperature and form a liquid pool on the bottom of said base portion.

7. The apparatus as in claim 6 in which said waste particulate material comprises solid polymers.

8. The apparatus as in claim 7 in which polymers are in the class of polyethylene and thermo plastic rubbers.

* * * * *